US007313355B2

(12) United States Patent
Isobe et al.

(10) Patent No.: US 7,313,355 B2
(45) Date of Patent: Dec. 25, 2007

(54) IMAGE FORMING APPARATUS

(75) Inventors: Akifumi Isobe, Hidaka (JP); Satoshi Sakata, Hino (JP); Hiroyuki Watanabe, Hachioji (JP); Hideo Yamane, Hachioji (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 178 days.

(21) Appl. No.: 11/300,560

(22) Filed: Dec. 13, 2005

(65) Prior Publication Data

US 2006/0214974 A1 Sep. 28, 2006

(30) Foreign Application Priority Data

Mar. 23, 2005 (JP) ..... 2005-083303

(51) Int. Cl.
*G03G 15/20* (2006.01)
*G03G 15/00* (2006.01)

(52) U.S. Cl. ..... 399/341; 399/406

(58) Field of Classification Search ..... 399/68, 399/322, 324, 341, 401, 406
See application file for complete search history.

(56) References Cited

U.S. PATENT DOCUMENTS 6,094,560 A * 7/2000 Thomas ..... 399/341
6,741,815 B1 * 5/2004 Fujita et al. ..... 399/45
2005/0207771 A1 * 9/2005 Kameda ..... 399/68

FOREIGN PATENT DOCUMENTS

| | | |
|---|---|---|
| JP | 09-022228 | 1/1997 |
| JP | 2003-066793 A | 3/2003 |
| JP | 2004-045723 A | 2/2004 |
| JP | 2004-109732 A | 4/2004 |

* cited by examiner

*Primary Examiner*—Hoang Ngo
(74) *Attorney, Agent, or Firm*—Frishauf, Holtz, Goodman & Chick, PC

(57) ABSTRACT

There is described an image forming apparatus, which forms high quality images free from a phenomenon of inter-sheet adhesion. The image forming apparatus includes a conveyance section to convey the transfer material along a conveying path; a cooling device disposed along the conveying path to cool the transfer material just after the toner image is fixed with heat; a controller-to control the conveyance section and the cooling device; and a first transfer-material detecting device disposed at a position adjacent to and upstream from the cooling device, in order to detect the transfer material coming into the conveying path. When the first transfer-material detecting device detects the transfer material coming, the controller controls the conveyance section to decelerate a conveyance velocity of the transfer material to a decelerated velocity lower than a normal conveyance velocity, so that the transfer material passes through the conveying path at the decelerated velocity.

20 Claims, 4 Drawing Sheets

IMAGE FORMING APPARATUS

This application is based on Japanese Patent Application NO. 2005-083303 filed on Mar. 23, 2005 in Japanese Patent Office, the entire content of which is hereby incorporated by reference.

BACKGROUND OF THE INVENTION

The present invention relates to an image forming apparatus and more particularly to an image forming apparatus having a cooling device for effectively cooling a transfer material on which a toner image is fixed and an image is formed.

In recent years, an image forming apparatus has been miniaturized and speeded up, so that a problem arises that heat generated from a fixing device raises the temperature in the main body of the image forming apparatus and when discharging a transfer material, on which a toner image is fixed and an image is formed, into a paper receiving tray, a phenomenon of "inter-sheet adhesion" occurs often.

"Inter-sheet adhesion" is a phenomenon that when a toner image is fixed on a transfer material by the fixing device and is discharged onto the paper receiving tray, before the toner image on the transfer material is cooled and dried sufficiently, the next transfer material is overlaid on it, thus the toner image on the preceding transfer material is adhered to the print side of the next transfer material, or in a case of double side print, when fixing the second side (rear), the print side of the first side (surface) is also heated, so that when the print sides of the preceding transfer material and next transfer material make contact with each other, the toner images are adhered, or in a case of face-up paper discharge, even after the toner image of the preceding transfer material is cooled and dried, by the heat of the transfer material next discharged to the toner image surface, the toner image of the preceding transfer material discharged before is melted and adhered to the transfer material.

Therefore, when the phenomenon of "inter-sheet adhesion" occurs, even if the adhered sheets are peeled off thereafter by a user, traces are left on the image itself, and such a sheet can be hardly used, thus how to effectively cool a transfer material on which an image is formed in the image forming apparatus comes into a problem.

Therefore, conventionally, an art equipped with, on the upstream side of a fixing section in the conveying direction of a medium to be recorded (transfer material), a cooling roller for cooling by conveying a transfer material and absorbing the heat of the transfer material and a cooling section for cooling the cooling roller (for example, refer to Patent Document 1) and an art for arranging a blower and a duct for cooling a transfer material on both sides of the transfer material in the width direction (for example, refer to Patent Document 2) are disclosed, and an art for controlling the cooling capacity of the cooling section on the basis of the outside air temperature and humidity condition, print mode selection condition, and transfer material kind selection condition (for example, refer to Patent Document 3) and an art for installing a first cooling section for cooling by applying air inside the apparatus to the image forming side of a transfer material and a second cooling section for cooling by applying external air introduced from outside the apparatus to the rear of the transfer material and when conveying a transfer material via a reversible conveying path, controlling so as to stop the second cooling section when the first cooling section is in operation (for example, refer to Patent Document 4) are disclosed.

[Patent Document 1]
Tokkai 2004-109732 (Japanese Non-Examined Patent Publication)
[Patent Document 2]
Tokkai 2003-66793 (Japanese Non-Examined Patent Publication)
[Patent Document 3]
Tokkai 2004-45723 (Japanese Non-Examined Patent Publication)
[Patent Document 4]
Japanese Patent JP-3347539

However, Patent Document 1 and Patent Document 2 relate to a constitution for improving the cooling effect, though depending on the internal space of a small image forming apparatus, a cooling roller and a duct for sufficiently heightening the cooling effect cannot be adopted, and even if the control described in Patent Document 3 is adopted, it is difficult to be well adapted to every condition, and when the control of Patent Document 4 is adopted, a problem arises that the scale and control of the cooling device are complicated, thus the cooling effect cannot be heightened by a simple constitution.

SUMMARY OF THE INVENTION

To overcome the abovementioned drawbacks in conventional image forming apparatus, it is an object of the present invention to provide an image forming apparatus for forming images with high quality without causing a phenomenon of inter-sheet adhesion.

Accordingly, to overcome the cited shortcomings, the abovementioned object of the present invention can be attained by an image forming apparatus, a cooling method, a storage device and a sheet conveying mechanism described as follow.

(1) An image forming apparatus, comprising: an image forming section to form an image on a transfer material through a fixing operation in which a toner image is fixed onto the transfer material by applying heat and pressure onto the toner image; a conveyance section to convey the transfer material along a conveying path; a cooling device that is disposed along the conveying path to cool the transfer material just after the toner image is fixed with heat; a controller to control the image forming section, the conveyance section and the cooling device; and a first transfer-material detecting device that is disposed at a position adjacent to and upstream from the cooling device in a conveying direction of the transfer material, in order to detect the transfer material coming into the conveying path; wherein, when the first transfer-material detecting device detects the transfer material coming into the conveying path, the controller controls the conveyance section to decelerate a conveyance velocity of the transfer material to a decelerated velocity lower than a normal conveyance velocity, so that the transfer material passes through the conveying path, equipped with the cooling device, at the decelerated velocity.

(2) A method, to be implemented in an image forming apparatus, for cooling a transfer material onto which a toner image is fixed by applying heat and pressure onto the toner image, the method comprising: conveying the transfer material along a conveying path so as to cool the transfer material by means of a cooling device disposed along the conveying path, just after the toner image is fixed onto the transfer material with heat; detecting the transfer material coming into the conveying path by means of a first transfer-material detecting device disposed at a position adjacent to and upstream from the cooling device in a conveying direction of the transfer material; and controlling an operation for conveying the transfer material in such a manner that, when the first transfer-material detecting device detects the transfer material coming into the conveying path, a conveyance velocity of the transfer material is decelerated to a decelerated velocity lower than a normal conveyance velocity, so that the transfer material passes through the conveying path, equipped with the cooling device, at the decelerated velocity.

(3) A storage device for storing a computer program, to be implemented in an image forming apparatus, for executing a cooling operation of a transfer material onto which a toner image is fixed by applying heat and pressure onto the toner image; wherein the computer program comprises the functional steps of: conveying the transfer material along a conveying path so as to cool the transfer material by means of a cooling device disposed along the conveying path, just after the toner image is fixed onto the transfer material with heat; detecting the transfer material coming into the conveying path by means of a first transfer-material detecting device disposed at a position adjacent to and upstream from the cooling device in a conveying direction of the transfer material; and controlling an operation for conveying the transfer material in such a manner that, when the first transfer-material detecting device detects the transfer material coming into the conveying path, a conveyance velocity of the transfer material is decelerated to a decelerated velocity lower than a normal conveyance velocity, so that the transfer material passes through the conveying path, equipped with the cooling device, at the decelerated velocity.

(4) A sheet conveying mechanism, to be employed in an image forming apparatus that forms an image on a sheet through a fixing operation in which a toner image is fixed onto the sheet by applying heat and pressure onto the toner image, the sheet conveying mechanism comprising: a conveyance section to convey the sheet along a conveying path; a cooling device that is disposed along the conveying path to cool the sheet just after the toner image is fixed onto the sheet with heat; a controller to control the conveyance section and the cooling device; and a first sheet detecting device that is disposed at a position adjacent to and upstream from the cooling device in a conveying direction of the sheet, in order to detect the sheet coming into the conveying path; wherein, when the first sheet detecting device detects the sheet coming into the conveying path, the controller controls the conveyance section to decelerate a conveyance velocity of the sheet to a decelerated velocity lower than a normal conveyance velocity, so that the sheet passes through the conveying path, equipped with the cooling device, at the decelerated velocity.

BRIEF DESCRIPTION OF THE DRAWINGS

Embodiments will now be described, by way of example only, with reference to the accompanying drawings which are meant to be exemplary, not limiting, and wherein like elements are numbered alike in several Figures, in which.

DETAILED DESCRIPTION OF THE PREFERRED EMBODIMENT

Figure 1:
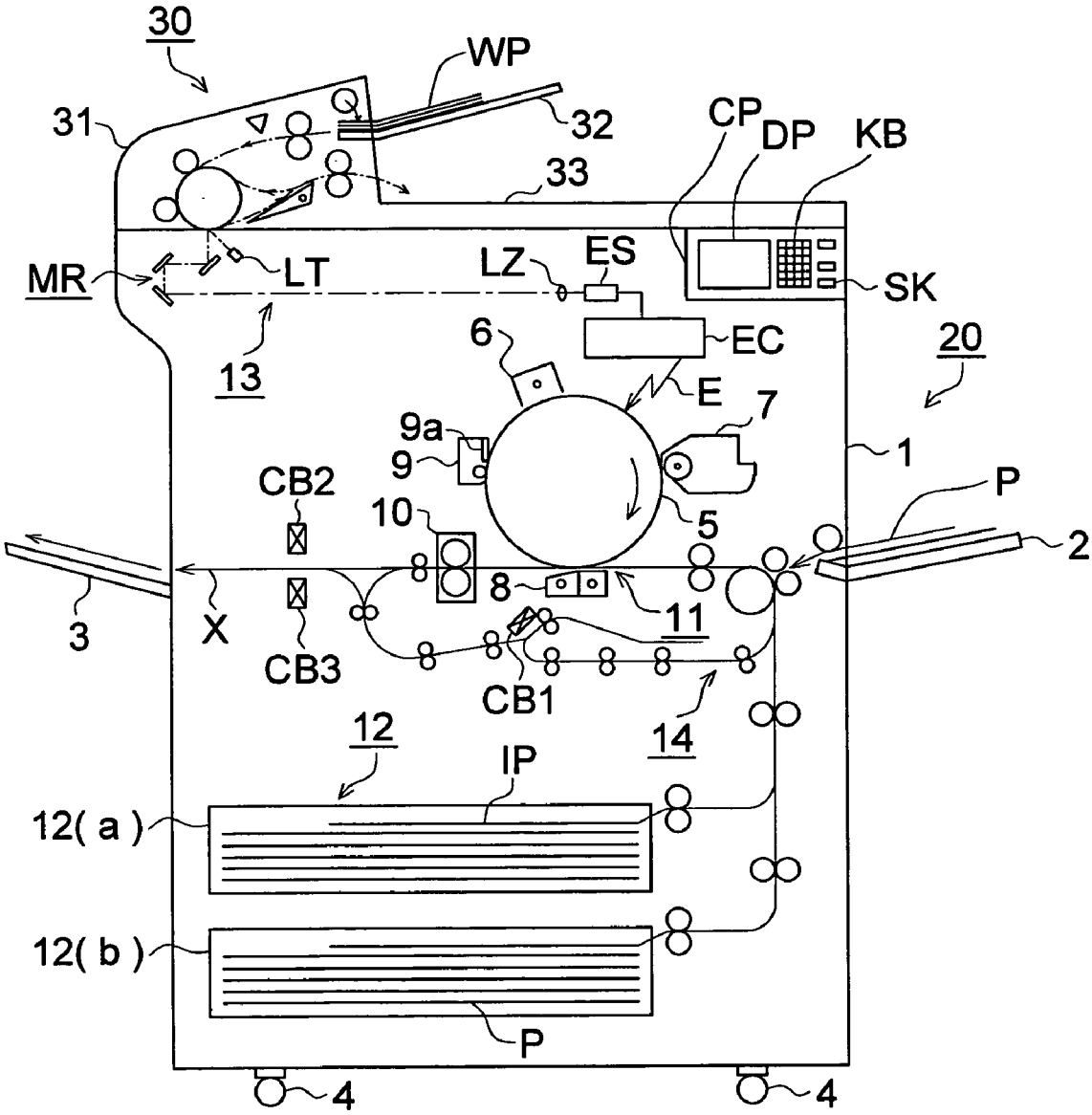
FIG. 1 is a schematic view of the image forming apparatus embodied in the present invention.

Hereinafter, the present invention will be explained in detail with reference to the accompanying drawings, though the present invention is not limited to it. Further, in the drawings, the same numerals indicate the same articles and by referring to the other related drawings when necessary, the present invention will be explained in detail.

Figure 2:
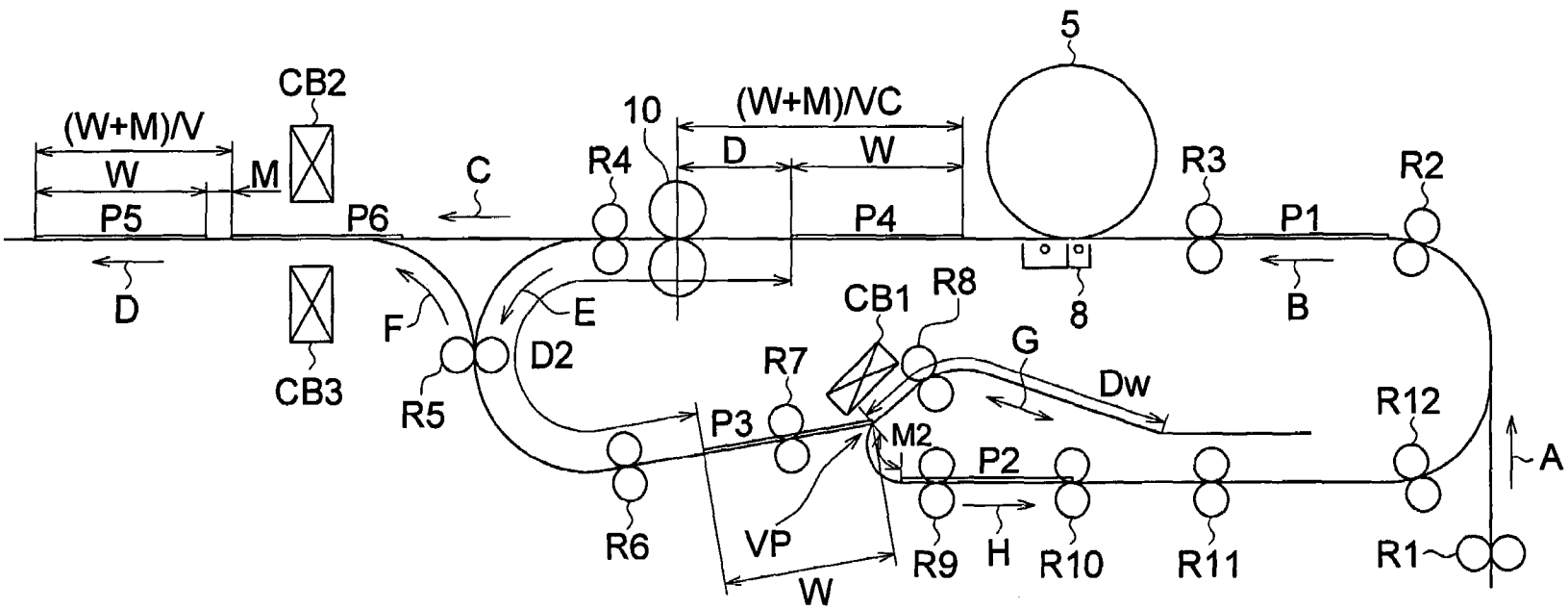
FIG. 2 is a schematic view of the conveying apparatus embodied in the present invention.
Figure 3:
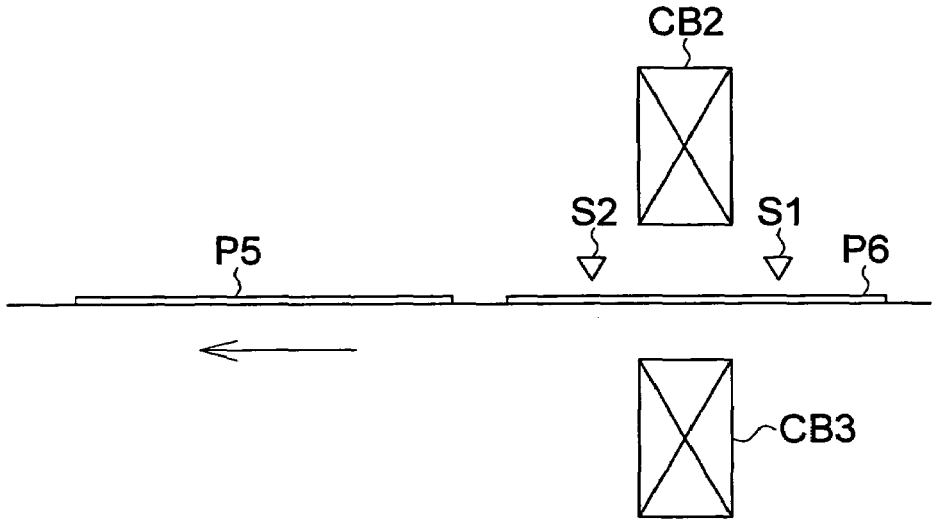
FIG. 3(A) and FIG. 3(B) are partially enlarged views of the schematic diagrams of the conveying apparatus embodied in the present invention.
Figure 3:
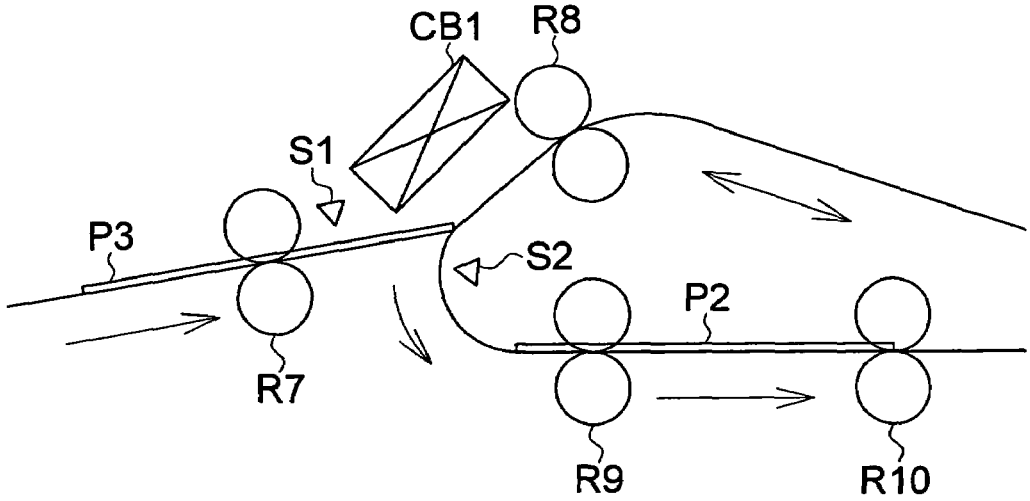
Figure 4:
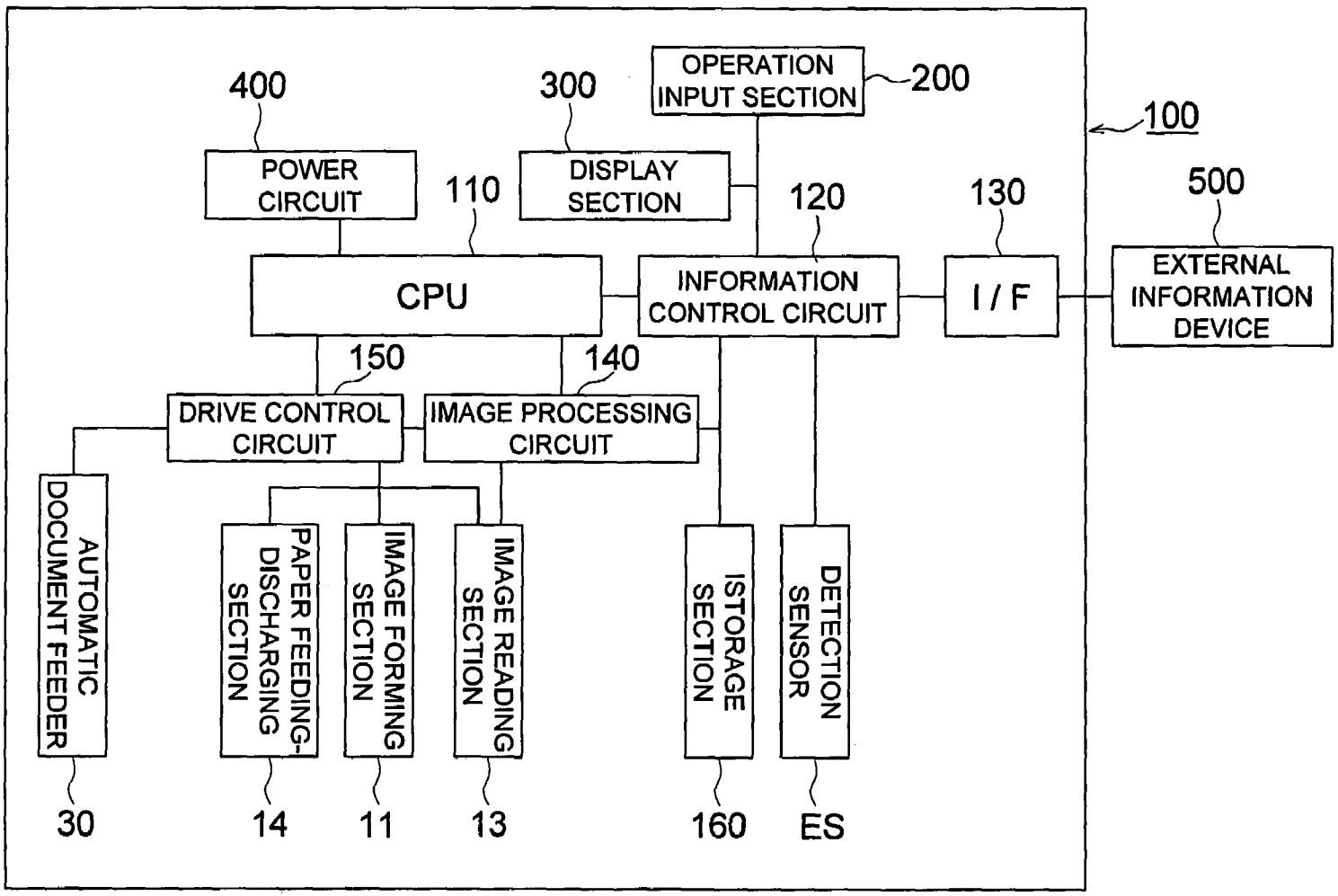
FIG. 4 is a circuit block diagram of the image forming apparatus embodied in the present invention.

FIG. 1 is a schematic view of the image forming apparatus relating to the present invention, and FIG. 2 is a schematic view of the conveying apparatus relating to the present invention, and FIG. 3(A) and FIG. 3(B) are partially enlarged views of the schematic diagrams of the conveying apparatus relating to the present invention, and FIG. 4 is a circuit block diagram of the image forming apparatus relating to the present invention.

The image forming constitution relating to the present invention will be explained by referring to FIG. 1.

An image forming apparatus 20 of the embodiment of the present invention is assumed as an electrophotographic copier for simplicity of explanation. The electrophotographic copier is well known, so that the parts directly independent of the present invention will be explained simply.

Numeral 20 indicates an image forming apparatus and 30 indicates an automatic document feeder (ADF) mounted in the image forming apparatus 20.

In the image forming apparatus 20, on the right side of a cabinet 1, a manual tray 2 for feeding a comparatively small amount of transfer materials (also referred to as ordinary paper, recording sheets, sheets, or sheets of paper) P is installed. Further, on the left side, a paper receiving tray 3 for discharging and loading an ordinary transfer material P which is formed with an image and is discharged, or thick paper or thin paper, or a special transfer material IP such as index paper is installed. And, at the bottom of the cabinet 1, a plurality of casters 4 for moving the image forming apparatus 20 are installed.

On the upper part of the front of the cabinet 1, a control panel CP as a display section and an operation input section for operating the image forming apparatus 20 is installed.

On the control panel CP, a display section DP made up of a liquid crystal display device or a touch panel type liquid crystal display device in which a touch panel is incorporated in a display device and an input device as an operation input section made up of a keyboard KB for inputting numerical values and a start button (may be referred to as a copy button) SK for executing a series of image forming operations such as copy are installed.

Inside the cabinet 1, a control section EC, an image forming section 11, an image reading section 13, and a paper feeding-discharging section 14 are installed.

The control section EC is called a control circuit, which is a control section for controlling all the operations of the image forming apparatus 20 and is made up of an electric circuit including a CPU. And, the control section EC, on the basis of the control program and control data stored in the CPU beforehand, drives and controls all the sections making up of the image forming apparatus 20.

Further, when ancillary devices such as an ADF 30 are connected to the image forming apparatus 20, the control section EC, similarly in cooperation with the ancillary devices, drives and controls the image forming apparatus 20 so as to smoothly operate it all as a system.

Furthermore, even when the apparatus is connected to a personal computer or other information devices by a LAN (local area network), the control section EC, in cooperation with these devices, can drive and control smoothly the image forming apparatus 20 including storing and transferring of information necessary for the operation.

The image forming section 11 is a section for forming an image on a transfer material on the basis of image information. For example, the image forming apparatus 20 is made up of a photosensitive drum (may be referred to as a photoconductor) 5 rotating in the imaging direction (for example, the clockwise direction indicated by the arrow) preset by a drive source such as a motor, a charging section 6 for uniformly charging the photosensitive drum 5, an exposing section E for emitting a laser beam as exposure light, which is, for example, converted to a signal on the basis of image information.(may be referred to as image data) of a document, from a laser output section (not drawn) equipped with a semiconductor laser to form an electrostatic latent image on the photosensitive drum 5, a developing section 7 for visualizing the electrostatic latent image formed on the photosensitive drum 5 as a toner image, a transfer-separation section 8 for transferring the toner image formed on the photosensitive drum 5 to the transfer material P, a cleaning section 9 having a cleaning blade 9*a* for scraping off toner and paper powder remaining on the photosensitive drum 5 after the toner image is transferred to the transfer material P, and a fixing section 10 for melting and fixing the transferred toner image to the transfer material P.

The image reading section 13 is made up of a reading optical system including a light source LT, mirrors MR, and a focusing lens LZ and a reader ES equipped with an electric circuit including a CCD (solid imaging device).

The reader ES, when the image forming apparatus 20 is a copier, reads image information of a document loaded on a platen glass (not drawn) installed on the upper part of the cabinet 1 and a document conveyed to the reading position by the automatic document reader 30, converts it to digital image data, and stores the image data in a storing section installed in the control section EC.

Further, when reading the document conveyed by the ADF 30 by the image reading section 13, the light source LT irradiates the document conveyed to the reading position, and the reflected light from the document is focused on the CCD surface of the reader ES by the focusing lens Lz via the mirrors MR, and the image information outputted by the CCD is stored as image data.

The paper discharging section 14 is made up of a paper feed cassette 12 and a transfer material conveying section including a motor as a drive source which is installed along the transfer material conveying path and a plurality of rollers.

Particularly, although will be detailed later, in this embodiment, to cool a transfer material with an image formed, a cooling section CB is installed along the conveying path.

Further, the cooling section, on the basis of the condition of temperature rise in the image forming apparatus, in consideration of the installation space and installation position, may be arranged in an appropriate place and for example, it is made up of a fan for blowing fresh air, a heat-absorption heat roller, a cooling roller for internally circulating cooing water, or a cooling plate. Or, the cooling section may be formed by properly combining them.

The paper feed cassette 12 is made up of a cassette 12*a* for storing special transfer materials IP, for example, thick paper and a cassette 12*b* for storing ordinary paper P.

The transfer material conveying section, although will be detailed later, by an instruction of the control section EC, on the basis of the information of transfer material kind selected and set by the display section DP installed on the control panel CP as an operation input section, selects special transfer material IP or ordinary paper P, then rotates a stepping motor which is a drive source, thereby drives to rotate a plurality of rollers, feeds and conveys the special transfer material IP or ordinary paper P toward the photosensitive drum 5 from the paper feed cassette 12 at appropriate timing, forms an image on one side or both sides of the transfer material, fixes it by the fixing section 10, then properly cools it by the cooling section CB, and discharges and conveys it to the paper receiving tray 3.

Further, the motor as a drive source is not limited to the stepping motor and an AC or DC motor may be used to control acceleration and deceleration.

With respect to the ADF 30, the whole conveying apparatus is covered with an ADF cabinet 31 and outside the ADF cabinet 31, a document table 32 and a paper discharge section 33 are installed.

On the document table 32, a plurality of documents WP with the document surface of the first page set on the uppermost position is loaded. The loaded documents WP are conveyed to the reading position by the document conveying apparatus made up of a plurality of rollers, are read by the reader ES, and are discharged to the paper discharge section 33.

Further, the ADF 30, by a drive control circuit not drawn, is operated in link motion with the control section EC of the image forming apparatus 20.

Next, the constitution and operation of the transfer material conveying section relating to the present invention will be explained by referring to FIG. 2.

When printing a one-side copy of forming an image on one side of a transfer material, by an instruction of the control section EC, the conveying rollers R1 to R12 operate according to a preset program, and the transfer material is conveyed in the direction indicated by the arrow A from the paper feed cassette 12 shown in FIG. 1 via the conveying roller R1 and when the transfer material reaches the position of the arrow B via the conveying roller R2, is stopped once at the position of the conveying roller R3 called a resist roller.

Namely, the resist roller R3, when a transfer material is conveyed from the paper feed cassette 12 or when a transfer material with an image formed on one side thereof for a double-side copy, which will be described later, is conveyed, to precisely transfer a toner image formed on the photosensitive drum 5 to the transfer material, since it is necessary to adjust the operation of the photosensitive drum 5 to the conveying operation of the transfer material in operation timing, stops once the transfer material conveyed and then conveys it at appropriate operation timing.

The transfer material is conveyed from the resist roller R3 at appropriate operation timing, and the toner image formed on the photosensitive drum 5 is transferred by the operation of the transfer-separation section 8, and when the transfer material separated from the photosensitive drum 5 passes through the fixing section 10, the toner image on the transfer material is fixed.

There are two transfer material discharging methods available and for example, in the one-side copy, there are a face-up discharging method of discharging sheets of paper with the image-formed side up and a face-down discharging method of discharging sheets of paper with the image-formed side down.

In this embodiment, in the face-up discharging method, a transfer material passing through the fixing section 10 is conveyed in the direction of the arrow C via the conveying roller R4, continuously conveyed in the direction of the arrow D by being cooled when passing the conveying path provided between a cooling section CB2 and a cooling section CB3 arranged in the opposite positions to each other, and then is discharged to the paper receiving tray 3 shown in FIG. 3(A) and FIG. 3(B).

Further, in the face-down discharging method, a transfer material passing through the fixing section 10 and then the conveying roller R4 is conveyed in the direction of the arrow E by the operation of a conveying path switching section not drawn, and immediately before the rear end of the transfer material passes through the conveying roller R5, the conveying roller 5 stops rotation and continuously starts the reverse rotation, thus the transfer material is reversed and conveyed in the direction of the arrow F, and the image-formed side is reversed down, and thereafter similarly to the face-up discharging method, the transfer material is conveyed in the direction of the arrow D by being cooled when passing the conveying path provided between the cooling section CB2 and the cooling section CB3, and then is discharged to the paper receiving tray 3.

When printing a double-side copy of forming images on both sides of a transfer material, the operation of forming an image on one side of the transfer material is the same as that of the one-side copy aforementioned, and after the transfer material with an image formed on one side passes through the fixing section 10 and then passes through the conveying roller R4, it is conveyed in the direction of the arrow E by the operation of the conveying path switching section and conveyed so as to enter the switchback type reversible conveying path via the conveying rollers R6 and R7 from the position indicated by the arrow VP.

In this embodiment, a cooling section CB1 is installed for the switchback type reversible conveying path, and as indicated by the arrow G, the transfer material is conveyed into the switchback type reversible conveying path, and when the rear end of the transfer material approaches the conveying roller R8, the conveying roller R8 stops rotation and starts the reverse rotation soon after it, so that the transfer material is conveyed in the direction of leaving the reversible conveying path.

The transfer material conveyed in the direction of leaving the reversible conveying path, by the operation of a conveying path switching section not drawn, at the position indicated by the arrow VP, is switched to another conveying path different from the conveying path through which it enters the reversible conveying path, and the transfer material turned upside down is conveyed in the direction of the arrow H via the conveying rollers R9, R10, and R11 and is stopped once at the position of the resist roller R3, though unlike the case of starting the one-side copy first, the transfer material is stopped once in the state that the side with an image formed is turned down.

Therefore, at the position of the resist roller R3, except that the transfer material is reversed in the switchback type reversible conveying path and the transfer material is stopped once in the state that the side with an image formed is turned down, the same conveying operation as that of the one-side copy aforementioned is performed, so that the double-side copy that images are formed on both sides of the transfer material is completed and the transfer material is discharged to the paper receiving tray 3.

Next, by referring to FIGS. 2 and 3, the conveyance velocity control of a transfer material for the cooling section will be explained.

FIG. 3(A) shows the neighborhood of the cooling section CB2 and CB3 installed in the conveying path after a transfer material passes through the fixing section 10, and numeral S1 indicates a front end detecting section of the transfer material, and S2 indicates a rear end detecting section of the transfer material. Further, FIG. 3(B) shows the neighborhood of the cooling section CB1 installed in the switchback type reversible conveying path, and similarly, S1 indicates a front end detecting section of the transfer material, and S2 indicates a rear end detecting section of the transfer material. Both drawings are partially enlarged views schematically showing the neighborhood of the cooling section CB shown in FIG. 2 and the same numerals as those shown in FIG. 2 indicate the same members.

As shown in FIG. 3(A), when a transfer material with an image formed is conveyed toward the cooling section CB2 and CB3 installed in the conveying path after the transfer material passes through the fixing section 10 and the transfer material enters the conveying path provided between the cooling section CB2 and CB3, if the front end of the transfer material is detected by the front end detecting section S1, the conveyance velocity is changed to a conveyance velocity decelerated from the ordinary conveyance velocity, and the transfer material passes through the conveying path provided between the cooling section CB2 and CB3 at the decelerated conveyance velocity by being cooled.

Further, when the transfer material leaves the conveying path provided between the cooling sections CB2 and CB3, if the rear end of the transfer material is detected by the rear end detecting section S2, to recover the time lag when passing through the conveying path opposite to the cooling section CB1, the conveyance velocity is accelerated and is controlled so as to be returned soon to the ordinary velocity.

Further, the ordinary conveyance velocity, in this embodiment, is referred to as a velocity when the transfer material is conveyed stably in the conveying path toward the photosensitive drum 5 and may be called a process velocity.

As shown in FIG. 3(B), when a transfer material with an image formed is conveyed toward the cooling section CB1 installed in the switchback type reversible conveying path and the transfer material enters the conveying path provided in the position opposite to the cooling section CB1, if the front end of the transfer material is detected by the front end detecting section S1, the conveyance velocity is changed to a conveyance velocity decelerated from the ordinary conveyance velocity, and the transfer material is conveyed through the switchback type reversible conveying path opposite to the cooling section CB1 at the decelerated conveyance velocity by being cooled.

Continuously, when the transfer material leaves the switchback type conveying path, if the rear end of the transfer material is detected by the rear end detecting section S2, to recover the time lag when passing through the conveying path opposite to the cooling section CB1, the conveyance velocity is accelerated and is controlled so as to be returned soon to the ordinary velocity, so that the transfer material is cooled by being conveyed at the conveyance velocity decelerated twice when it enters and leaves the switchback type conveying path.

Further, when detecting the conveying condition of transfer materials, needless to say, which is to be detected, the front end of transfer materials or the rear end may be selected and adopted properly according to the control system of the image forming apparatus.

Next, a calculation example of the decelerated velocity will be indicated below.

For example, the length of transfer materials is assumed as W (mm), the transfer material interval to be ensured between the preceding transfer material and the subsequent one at its minimum after deceleration as M (mm), the ordinary conveyance velocity as VC (mm/s), the transfer material interval at the ordinary conveyance velocity as D (mm), the reversible conveying path distance (may be referred to as leading distance or discharge distance) as Dw (mm), and the decelerated conveyance velocity as V (mm/s).

For the cooling sections CB2 and CB3 installed in the conveying path after a transfer material passes through the fixing section 10 as shown in FIG. 3(A), as shown in FIG. 2, assuming the condition that the transfer material is conveyed toward the fixing device at the ordinary conveyance velocity as P4 and the condition immediately after the transfer material passes through the conveying path provided between the cooling sections CB2 and CB3 at the decelerated conveyance velocity as P5, the succeeding transfer material is in the P6 state, so that a relationship of $(W+M)/V=(W+D)/VC$ is held.

Therefore, the decelerated conveyance velocity $V=((W+M)/(W+D))\times VC$.

Further, for the cooling section CB1 installed in the switchback type reversible conveying path as shown in FIG. 3(B), as shown in FIG. 2, assuming the condition that the transfer material is conveyed toward the fixing device at the ordinary conveyance velocity as P4 and the condition immediately after the transfer material leaves the switchback type reversible conveying path at the decelerated conveyance velocity as P2, the succeeding transfer material is in the P3 state, so that a relationship of $(Dw+Dw+M2)/V=(D2+W)/VC$ is held.

Therefore, the decelerated conveyance velocity becomes $V=((2\times Dw+M2)/(D2+W))\times VC$.

Further, in this embodiment, as a drive source for the conveying rollers for conveying transfer materials, the stepping motor is used for drive and control so as to easily switch the conveyance velocity. However, the drive source for the conveying rollers is not limited to it.

Further, when changing the conveyance velocity, strictly speaking, in consideration of the time required for the stepping motor to be decelerated or accelerated to a predetermined velocity and the distance of transfer materials conveyed in this period, the calculation formula aforementioned is complicated slightly. However, as a compensation of these elements, by compensating for it by the transfer material interval (M) to be ensured at its minimum between the preceding transfer material and the succeeding one after deceleration, the elements can be controlled sufficiently by the simple calculation formula aforementioned.

Further, needless to say, as shown in FIG. 2, assuming the condition that the transfer material leaves the switchback type reversible conveying path and is accelerated as P2 and the preceding transfer material as P1, it is necessary to set the conveyance velocity to be accelerated so as to prevent a rear-end collision with the transfer material in the P1 condition and control so as to return the accelerated conveyance velocity to the ordinary conveyance velocity.

Therefore, to actually heighten the cooling effect, when applying the velocity change control explained in this embodiment to an image forming apparatus, on the basis of the ordinary conveyance velocity and the length of the conveying path which are used in the image forming apparatus to be applied to, it is preferable to properly set the aforementioned decelerated conveyance velocity and accelerated conveyance velocity.

Next, the circuit constitution of the image forming apparatus will be explained by referring to FIG. 4.

In this embodiment, for simplicity of explanation, the image forming apparatus uses a copier and when forming an image on the basis of image information, the cooling section for cooling a transfer material with an image formed is arranged along the conveying path.

Therefore, the control circuit of this embodiment controls image forming on a transfer material and particularly controls the conveyance velocity of the transfer material for the cooling section.

Numeral 100 indicates a constitution of the sections and circuits of the overall image forming apparatus 20, and 110 indicates a CPU for controlling the overall image forming apparatus, which stores beforehand programs in various modes for controlling the image forming apparatus 20 and data necessary to execute the programs.

To the CPU 110 installed in the control section EC, an information control circuit 120, an image processing circuit 140, a drive control circuit 150, and a power circuit 400 are connected. And, the control section EC is made up of these circuits shown in FIG. 1, thus the overall image forming apparatus 20 can be controlled.

The information control circuit 120, by an instruction of the CPU 110, is connected to an external information device 500 via an interface (I/F) 130, inputs image information of characters and images and set information of the density and magnification necessary for image forming as job information in a 1-job unit which is one printing unit, and stores them in a storage section 160.

And, the information control circuit 120 outputs the set information stored in the storage section 160 to the image processing circuit 140, the drive control circuit 150, or a display section 300.

Further, the information control circuit 120 has a function for inputting and outputting not only the job information made up of the image information inputted from the external information device 500 and the set information but also instruction information necessary to operate the circuits including the image processing circuit 140 and the drive control circuit 150 and various sections and for properly and smoothly transferring various information inputted by an operation input section 200 to the circuits and sections of the image forming apparatus so as to prevent the operation of the image forming apparatus from being impeded.

Further, the external information device 500 is mainly a computer or an internet server, though in certain circumstances, another image forming apparatus connected to a local area network (LAN) may be supposed.

Further, in this embodiment, by operating, for example, a keyboard KB as an output count setting section of the operation input section 200 which will be described later, the output number of image-formed transfer materials continuously outputted, for example, the number of copies and the number of sets can be set, and the information control circuit 120 stores the number of copies and the number of sets set by the operation input section 200 in the storage section 160 and presets and stores the output number of transfer materials continuously outputted for each image forming apparatus.

And, if the number of copies and the number of sets inputted by the keyboard KB are smaller than the preset number of transfer materials which can be outputted continuously, when cooling image-formed transfer materials by the cooling section CB installed along the transfer material conveying path, the information control circuit 120 controls not to execute the change control of the conveyance velocity of transfer materials.

Namely, the inter-sheet adhesion phenomenon occurs easily when outputting transfer materials on which images are formed continuously, so that the number of continuous copies probably causing an occurrence of the inter-sheet adhesion phenomenon is stored beforehand for each image forming apparatus and when a number of copies smaller than it is set by the keyboard KB, the information control circuit 120 controls not to execute the change control of the transfer material conveyance velocity of deceleration or acceleration when cooling the transfer material by the cooling section, thus high-quality images free of an occurrence of the inter-sheet adhesion phenomenon can be formed free of decrease in productivity.

Further, when a one-side copy mode is set by a copy mode setting section for selecting and setting the one-side copy mode for forming and outputting an image on one side of a transfer material, the transfer material passes only once through the fixing device, so that the image forming apparatus is not filled with heat, and the inter-sheet adhesion occurs very hardly, thus the conveyance velocity change control for changing the transfer material conveyance velocity for the cooling section is not executed, and an image forming apparatus for forming high quality images free of decrease in productivity can be provided.

Particularly in this embodiment, the information control circuit 120, when, during the conveying operation of transfer materials, inputting detection information of the front end or rear end of each transfer material from a detection sensor section ES which will be described later, sets the conveyance velocity for decelerating or accelerating the ordinary conveyance velocity of transfer materials, operates the transfer material conveying section via the drive control circuit 150, and executes the change control of the conveyance velocity of transfer materials.

Further, the conveyance velocity for decelerating or accelerating the ordinary conveyance velocity of transfer materials may be calculated whenever controlling the change in the conveyance velocity, though to simplify the control circuit, it is desirable to store it beforehand in the storage section 160.

The interface (I/F) 130 is an information transfer section, which is structured so as to be connected to the aforementioned external information device 500 such as a computer, another image forming apparatus, or an internet server via various networks.

The operation input section 200 is an input device installed in the control panel CP of the image forming apparatus 20. The liquid crystal display device DP having a touch panel, the keyboard KB, and the start button SK which are mentioned above are supposed.

Further, the operation input section 200, in certain circumstances, serves as an input section for setting various operation modes of the image forming apparatus 20.

In this embodiment, the function as a copy mode setting section for selecting and setting a one-side copy mode or a double-side copy mode for forming and outputting an image on one side or both sides of a transfer material is provided in the operation input section 200.

The display section 300 is made up of the aforementioned liquid crystal display device or the display device DP in which a touch panel is incorporated in the liquid crystal display unit.

On the display section 300, the operation procedure when inputting information by the operation input section 200, a list of various information, information stored in the storage section 160, and the condition and warnings during the operation of the image forming apparatus are displayed.

The image processing circuit 140 is a circuit for converting image information of a document read by the image reading section 13, for example, to digital by an instruction of the CPU 110, storing it in the storage section 160 as image data, and when forming an image by the image forming section 11 on the basis of the image data stored in the storage section 160, converting it to data or a signal suited to the image forming method of the image forming section 11.

The drive control circuit 150 is a circuit for operating, by an instruction of the CPU 110, the image forming section 11, the image reading section 13, the paper discharging section 14, and the ADF 30 at appropriate timing on the basis of the preset operation mode so as to perform the image forming operation.

Further, in this embodiment, particularly, by an instruction of the information control circuit 120, the cooling section CB is operated, and the transfer material conveying section is also operated, and the rotational speed of the conveying rollers is changed, so that the conveyance velocity of transfer materials is decelerated or accelerated, thus the change of the conveyance velocity is controlled.

Further, regarding the operation control of the cooling section, for example, a temperature detecting section for detecting the temperature in the image forming apparatus is installed, and when the temperature in the image forming apparatus is a predetermined temperature or lower, by an instruction of the information control circuit 120, the cooling section may not be operated.

The storage section 160 stores job information and job data made up of image-data necessary to form images and set conditions for controlling the image forming apparatus 20 and information of programs in various modes.

Further, as described above, in this embodiment, the number of copies and the number of sets inputted by the keyboard KB and the number of transfer materials continuously outputted which is preset for each image forming apparatus are stored. In this connection, in a recent high-speed copier, the output number of transfer materials continuously outputted is set, for example, to about 5000 sheets.

The image forming section 11, as shown in FIG. 1, is made up of the photosensitive drum 5, the charging section 6, the developing section 7, the transfer-separation section 8, the cleaning section 9, and the fixing section 10 and is driven by the drive control circuit 150.

On the basis of the image data read by the image reading section 13 and stored in the storage section 160, an image is formed on the photosensitive drum 5 by being controlled by the job information and job data and it is transferred and recorded on ordinary paper or a special transfer material IP.

The image reading section 13, as shown in FIG. 1, is made up of the reading optical system and the reader ES. The image information of a document operated by the drive control circuit 150 and conveyed to the reading position is read by the reader ES and the read image information is converted to digital image data, for example, by the image processing circuit 140 and is stored in the storage section 160.

The paper discharging section 14, as shown in FIG. 1, is made up of the paper feed cassette 12 for storing special transfer materials IP and ordinary paper P and the transfer material conveying section including a motor as a drive source installed along the conveying path of transfer materials and a plurality of conveying rollers and particularly in this embodiment, to cool transfer materials with an image formed, the cooling section CB is installed along the conveying path.

Further, the transfer material conveying section, by an instruction of the CPU 110, rotates the motor which is a drive source, thereby drives a plurality of conveying rollers to rotate, feeds and conveys a special transfer material IP or ordinary paper P toward the photosensitive drum 5 from the paper feed cassette 12 at appropriate timing, forms an image on one side or both sides of the transfer material, fixes it by the fixing section 10, then properly cools it by the cooling section CB, and discharges and conveys it to the paper receiving tray 3.

The detection sensor section ES is made up of the front end detecting section S1 for detecting the front end of a transfer material and the rear end detecting section S2 for detecting the rear end of the transfer material. And, in this embodiment, particularly when the front end detecting section S1 or the rear end detecting section S2 detects the front end or rear end of a transfer material, the information control circuit 120 operates the transfer material conveying section via the drive control circuit 150 and changes the rotational speed of the conveying rollers, thereby decelerates or accelerates the conveyance velocity of transfer materials, and controls of the change in the conveyance velocity.

The automatic document feeder (ADF) 30, as shown in FIG. 1, is a device for automatically conveying documents loaded on the document table 32 one by one to the reading position by the document conveying device and by an instruction of the CPU 110 of the image forming apparatus 20, operates in link motion with the drive control circuit 150.

The power circuit 400, when a power switch (not drawn) is turned on by an operation of a user, appropriately supplies an electric current to the whole image forming apparatus from the power source and when the power switch is turned off, interrupts the supply of electric current.

Further, even if the power switch is turned on, for example, in the power consumption mode for putting the image forming apparatus into the standby state, by an instruction of the CPU 110, the power circuit continues only the supply of electric current necessary to retain the temporary storage contents in the memory and interrupts another supply of electric current to the heater of the fixing section.

Here, the image forming operation will be explained simply.

Documents conveyed by the ADF 30 or documents loaded on the platen glass are read by the image reading section 13 and are stored in the storage section 160 as image information. When forming images, the photosensitive drum 5 is rotated in the preset direction indicated by the arrow, and the surface of the photosensitive drum 5 is charged by the charging section 6, and then the image information read from the storage section 160 is read in the 1-job unit, and an electrostatic latent image is formed by the exposure light E of the exposing section. The formed electrostatic latent image is developed by the developing section 7 and is visualized as a toner image. The toner image formed on the photosensitive drum 5 is transferred to a transfer material P conveyed at appropriated timing from the paper feed cassette 12 by the transfer-separation section 8, is fixed via the fixing section 10, and is discharged to the paper receiving tray 3.

On the other hand, the photosensitive drum 5 from which the toner image is transferred to the transfer material P is rotated furthermore, and the toner and paper powder remaining on the surface of the photosensitive drum 5 are scrapped off by the cleaning blade 9*a* of the cleaning section 9, and then if there is image information available, the aforementioned operation is repeated, and if there is not, the image forming operation is finished, and the image forming apparatus enters the standby state.

The conveyance velocity control of transfer materials with an image formed when the cooling section is provided in the conveying path of the image forming apparatus and particularly the conveyance velocity change control such as decelerating when the transfer materials with an image formed enter the conveying path where the cooling section is installed and accelerating when the transfer materials leave the conveying path are explained above. However, the control can be applied similarly to an image forming apparatus with a post-processor installed.

Namely, when the cooling section is installed in the conveying path of the post-processor, needless to say, the same conveyance velocity change control as the aforementioned may be executed for transfer materials conveyed.

Further, although detailed explanation by an illustration is omitted, when the post-processor has a stacking section made up of a plurality of stages of stacks for temporarily loading transfer materials with an image formed outputted from the image forming apparatus one by one or set by set, it is possible to install cooling section respectively for the plurality of stages of stacks and cool the respective stacks.

Further, for example, it is possible to arrange cooling section fewer than the stack stages in the vertical direction, vertically move a plurality stages of stacks every appropriate number of stages such as every one stage or two stages for the cooling section, and cool them.

Further, when cooling the stacks of the post-processor, in any case, by a method for outputting transfer materials with an image formed from the processor in the order in which they are outputted from the image forming apparatus, that is, a pushup method, the transfer materials are outputted from the post-processor, thus the transfer materials loaded on the respective stacks are cooled within a fixed time, and it is desirable to prevent the stacks of the post-processor from an occurrence of the inter-sheet adhesion phenomenon.

As explained above, in this embodiment, basically, when a transfer material with an image formed enters the conveying path where a cooling section is installed, the conveyance velocity is changed to a conveyance velocity decelerated from the ordinary conveyance velocity, and the transfer material passes through the conveying path where the cooling section is installed at the decelerated conveyance velocity, thus the cooling effect is heightened by prolonging the passing time, and when the transfer material leaves the conveying path where the cooling section is installed, the conveyance velocity is decelerated when it passes through the conveying path where the cooling section is installed, thus to recover the time difference delayed from the ordinary conveyance velocity, the conveyance velocity is accelerated and is controlled to be soon returned to the ordinary velocity, thus similarly to the case that the transfer material is conveyed at the ordinary conveyance velocity, even if the cooling effect is heightened, the time required for image forming is not prolonged, so that a high-quality image forming operation can be performed free of decrease in productivity.

Namely, in the present invention, when the transfer material detecting section detects that a transfer material with an image formed enters the cooling section, the conveyance velocity of the transfer material is decelerated to a conveyance velocity lower than the ordinary conveyance velocity, and the transfer material passes through the conveying path where the cooling section is installed at the decelerated conveyance velocity, so that the cooling time can be prolonged, and the cooling effect is heightened, and an image forming apparatus for forming high-quality images can be provided.

Further, when the transfer material detecting section detects that the transfer material leaves the cooling section, the conveyance velocity of the transfer material is accelerated, and the time difference due to the ordinary conveyance velocity when the transfer material passes through the conveying path where the cooling section is installed and the decelerated conveyance velocity is recovered, and an image forming apparatus for forming high-quality images free of decrease in productivity can be provided.

Further, when the output number of transfer materials set by the output count setting section is smaller than the preset number of transfer materials outputted continuously, the conveyance velocity change control for changing the conveyance velocity of transfer materials for the cooling section is not executed, so that for example, if the continuous output count little possible to generate the inter-sheet adhesion phenomenon is set as a preset number of transfer materials outputted continuously, when the output count is smaller than it, the conveyance velocity change control is not executed, and an image forming apparatus for forming high-quality images free of decrease in productivity can be provided.

Further, in the one-side copy mode, the transfer material passes only once through the fixing device, so that the image forming apparatus is not filled with heat, and the inter-sheet adhesion occurs very hardly, thus when the one-side copy mode is selected by the copy mode setting section, the conveyance velocity change control for changing the transfer material conveyance velocity for the cooling section is not executed, and an image forming apparatus for forming high quality images free of decrease in productivity can be provided.

Further, the cooling section is arranged for the switchback type conveying path, so that when transfer materials move back and forth on the switchback type conveying path, they are cooled twice, so that the cooling effect is heightened and an image forming apparatus for forming high quality images can be provided.

Particularly, if the image forming apparatus has a double-side copy function of a double side alternate conveying type for forming an image on the surface of a transfer material and then forming an image on the rear of the transfer material, when executing double side copy, the transfer material interval in the conveying path of transfer materials is widened, and the rear conveyance velocity when forming an image on the rear is made lower, so that the conveyance velocity change control aforementioned is executed, thus better results are obtained.

Further, in this embodiment, with respect to the cooling section installed in the conveying path after transfer materials pass through the fixing section 10, the two cooling sections are arranged opposite to each other across the conveying path, though depending on the cooling performance of the cooling section, one unit may be acceptable and the arranging method is not limited to it.

Further, the arrangement of the cooling section is decided depending on the functional performance of the image forming apparatus, the internal space, and the cooling performance of the cooling section, so that it is not limited to this embodiment.

Further, in this embodiment, as an image forming apparatus, an example of a copier is explained. However, the image forming apparatus is not limited to the copier and needless to say, it may be a printer, a facsimile device, and a composite device thereof.

According to the present invention, the following effects can be attained.

(1) In the present invention, when the transfer material detecting section detects that a transfer material with an image formed enters the cooling section, the conveyance velocity of the transfer material is decelerated to a conveyance velocity lower than the ordinary conveyance velocity, and the transfer material passes through the conveying path where the cooling section is installed at the decelerated conveyance velocity, so that the cooling time can be prolonged, and the cooling effect is heightened, and an image forming apparatus for forming high-quality images can be provided.

(2) Further, when the transfer material detecting section detects that the transfer material leaves the cooling section, the conveyance velocity of the transfer material is accelerated, and the time difference due to the ordinary conveyance velocity when the transfer material passes through the conveying path where the cooling section is installed and the decelerated conveyance velocity is recovered, and an image forming apparatus for forming high-quality images free of decrease in productivity can be provided.

(3) Further, when the output number of transfer materials set by the output count setting section is smaller than the preset number of transfer materials outputted continuously, the conveyance velocity change control for changing the conveyance velocity of transfer materials for the cooling section is not executed, so that for example, if the continuous output count little possible to generate the inter-sheet adhesion phenomenon is set as a preset number of transfer materials outputted continuously, when the output count is smaller than it, the conveyance velocity change control is not executed, and an image forming apparatus for forming high-quality images free of decrease in productivity can be provided.

(4) Further, in the one-side copy mode, the transfer material passes only once through the fixing device, so that the image forming apparatus is not filled with heat, and the inter-sheet adhesion occurs very hardly, thus when the one-side copy mode is selected by the copy mode setting section, the conveyance velocity change control for changing the transfer material conveyance velocity for the cooling section is not executed, and an image forming apparatus for forming high quality images free of decrease in productivity can be provided.

(5) Further, the cooling section is arranged for the switchback type conveying path, so that when transfer materials move back and forth on the switchback type conveying path, they are cooled twice, so that the cooling effect is heightened and an image forming apparatus for forming high quality images can be provided.

(6) Particularly, if the image forming apparatus has a double-side copy function of a double side alternate conveying type for forming an image on the surface of a transfer material and then forming an image on the rear of the transfer material, when executing double side copy, the transfer material interval in the conveying path of transfer materials is widened, and the rear conveyance velocity when forming an image on the rear is made lower, so that the conveyance velocity change control aforementioned is executed, thus better results are obtained.

While the preferred embodiments of the present invention have been described using specific term, such description is for illustrative purpose only, and it is to be understood that changes and variations may be made without departing from the spirit and scope of the appended claims.

What is claimed is:

1. An image forming apparatus, comprising:

an image forming section to form an image on a transfer material through a fixing operation in which a toner image is fixed onto said transfer material by applying heat and pressure onto said toner image;

a conveyance section to convey said transfer material along a conveying path;

a cooling device that is disposed along said conveying path to cool said transfer material just after said toner image is fixed with heat;

a controller to control said image forming section, said conveyance section and said cooling device; and a first transfer-material detecting device that is disposed at a position adjacent to and upstream from said cooling device in a conveying direction of said transfer material, in order to detect said transfer material coming into said conveying path;

wherein, when said first transfer-material detecting device detects said transfer material coming into said conveying path, said controller controls said conveyance section to decelerate a conveyance velocity of said transfer material to a decelerated velocity lower than a normal conveyance velocity, so that said transfer material passes through said conveying path, equipped with said cooling device, at said decelerated velocity.

2. The image forming apparatus of claim 1, further comprising:

a second transfer-material detecting device that is disposed at a position adjacent to and downstream from said cooling device in a conveying direction of said transfer material, in order to detect said transfer material going out said conveying path;

wherein, when said second transfer-material detecting device detects said transfer material going out said conveying path, said controller controls said conveyance section to accelerate a conveyance velocity of said transfer material, so that said transfer material resumes said normal velocity.

3. The image forming apparatus of claim 1, further comprising:

an output number setting section to input and set an output number of transfer materials, on which images are formed respectively; and a storing section to store a predetermined number of transfer materials to be outputted continuously;

wherein, when said output number of transfer materials set by said output number setting section is smaller than said predetermined number of transfer materials to be outputted continuously, said controller refrains from conducting an operation for changing said conveyance velocity of said transfer material.

4. The image forming apparatus of claim 1, further comprising:

a copy mode setting section to select and set a one-side copy mode in which said image is formed on only a one-side of said transfer material to be outputted;

wherein, when said one-side copy mode is selected through said copy mode setting section, said controller refrains from conducting an operation for changing said conveyance velocity of said transfer material.

5. The image forming apparatus of claim 1, further comprising:

a switchback type conveyance path that is provided in said conveying path to invert an obverse or reverse surface of said transfer material relative to each other;

wherein at least another cooling device is disposed along said switchback type conveyance path.

6. A method, to be implemented in an image forming apparatus, for cooling a transfer material onto which a toner image is fixed by applying heat and pressure onto said toner image, said method comprising:

conveying said transfer material along a conveying path so as to cool said transfer material by means of a cooling device disposed along said conveying path, just after said toner image is fixed onto said transfer material with heat;

detecting said transfer material coming into said conveying path by means of a first transfer-material detecting device disposed at a position adjacent to and upstream from said cooling device in a conveying direction of said transfer material; and controlling an operation for conveying said transfer material in such a manner that, when said first transfer-material detecting device detects said transfer material coming into said conveying path, a conveyance velocity of said transfer material is decelerated to a decelerated velocity lower than a normal conveyance velocity, so that said transfer material passes through said conveying path, equipped with said cooling device, at said decelerated velocity.

7. The method of claim 6, further comprising:

detecting said transfer material going out said conveying path by means of a second transfer-material detecting device disposed at a position adjacent to and downstream from said cooling device in a conveying direction of said transfer material;

controlling an operation for conveying said transfer material in such a manner that, when said second transfer-material detecting device detects said transfer material going out said conveying path, a conveyance velocity of said transfer material is accelerated, so that said transfer material resumes said normal velocity.

8. The method of claim 6, further comprising:

inputting and setting an output number of transfer materials on which images are formed respectively; and storing a predetermined number of transfer materials to be outputted continuously;

wherein, when said output number of transfer materials, set in said inputting and setting step, is smaller than said predetermined number of transfer materials to be outputted continuously, an operation for changing said conveyance velocity of said transfer material is kept inactive.

9. The method of claim 6, further comprising:

selecting and setting a one-side copy mode in which said image is formed on only a one-side of said transfer material to be outputted;

wherein, when said one-side copy mode is selected in said selecting and setting step, an operation for changing said conveyance velocity of said transfer material is kept inactive.

10. The method of claim 6, further comprising:

inverting an obverse or reverse surface of said transfer material relative to each other by means of a switchback type conveyance path provided in said conveying path;

wherein at least another cooling device is disposed along said switchback type conveyance path.

11. A storage device for storing a computer program, to be implemented in an image forming apparatus, for executing a cooling operation of a transfer material onto which a toner image is fixed by applying heat and pressure onto said toner image;

wherein said computer program comprises the functional steps of:

conveying said transfer material along a conveying path so as to cool said transfer material by means of a cooling device disposed along said conveying path, just after said toner image is fixed onto said transfer material with heat;

detecting said transfer material coming into said conveying path by means of a first transfer-material detecting device disposed at a position adjacent to and upstream from said cooling device in a conveying direction of said transfer material; and controlling an operation for conveying said transfer material in such a manner that, when said first transfer-material detecting device detects said transfer material coming into said conveying path, a conveyance velocity of said transfer material is decelerated to a decelerated velocity lower than a normal conveyance velocity, so that said transfer material passes through said conveying path, equipped with said cooling device, at said decelerated velocity.

12. The storage device of claim 11, wherein said computer program further comprises the functional steps of:

detecting said transfer material going out said conveying path by means of a second transfer-material detecting device disposed at a position adjacent to and downstream from said cooling device in a conveying direction of said transfer material;

controlling an operation for conveying said transfer material in such a manner that, when said second transfer-material detecting device detects said transfer material going out said conveying path, a conveyance velocity of said transfer material is accelerated, so that said transfer material resumes said normal velocity.

13. The storage device of claim 11, wherein said computer program further comprises the functional steps of:

inputting and setting an output number of transfer materials on which images are formed respectively; and storing a predetermined number of transfer materials to be outputted continuously;

wherein, when said output number of transfer materials, set in said inputting and setting step, is smaller than said predetermined number of transfer materials to be outputted continuously, an operation for changing said conveyance velocity of said transfer material is kept inactive.

14. The storage device of claim 11, wherein said computer program further comprises the functional steps of:

selecting and setting a one-side copy mode in which said image is formed on only a one-side of said transfer material to be outputted;

wherein, when said one-side copy mode is selected in said selecting and setting step, an operation for changing said conveyance velocity of said transfer material is kept inactive.

15. The storage device of claim 11, wherein said computer program further comprises the functional steps of:

inverting an obverse or reverse surface of said transfer material relative to each other by means of a switchback type conveyance path provided in said conveying path;

wherein at least another cooling device is disposed along said switchback type conveyance path.

16. A sheet conveying mechanism, to be employed in an image forming apparatus that forms an image on a sheet through a fixing operation in which a toner image is fixed onto said sheet by applying heat and pressure onto said toner image, said sheet conveying mechanism comprising:

a conveyance section to convey said sheet along a conveying path;

a cooling device that is disposed along said conveying path to cool said sheet just after said toner image is fixed onto said sheet with heat;

a controller to control said conveyance section and said cooling device; and a first sheet detecting device that is disposed at a position adjacent to and upstream from said cooling device in a conveying direction of said sheet, in order to detect said sheet coming into said conveying path;

wherein, when said first sheet detecting device detects said sheet coming into said conveying path, said controller controls said conveyance section to decelerate a conveyance velocity of said sheet to a decelerated velocity lower than a normal conveyance velocity, so that said sheet passes through said conveying path, equipped with said cooling device, at said decelerated velocity.

17. The sheet conveying mechanism of claim 16, further comprising:

a second sheet detecting device that is disposed at a position adjacent to and downstream from said cooling device in a conveying direction of said sheet, in order to detect said sheet going out said conveying path;

wherein, when said second sheet detecting device detects said sheet going out said conveying path, said controller controls said conveyance section to accelerate a conveyance velocity of said sheet, so that said sheet resumes said normal velocity.

18. The sheet conveying mechanism of claim 16, wherein said image forming apparatus includes:

an output number setting section to input and set an output number of sheets, on which images are formed respectively; and a storing section to store a predetermined number of sheets to be outputted continuously; and wherein, when said output number of sheets set by said output number setting section is smaller than said predetermined number of sheets to be outputted continuously, said controller refrains from conducting an operation for changing said conveyance velocity of said sheet.

19. The sheet conveying mechanism of claim 16, wherein said image forming apparatus includes:

a copy mode setting section to select and set a one-side copy mode in which said image is formed on only a one-side of said sheet to be outputted;

wherein, when said one-side copy mode is selected through said copy mode setting section, said controller refrains from conducting an operation for changing said conveyance velocity of said sheet.

20. The sheet conveying mechanism of claim 16, further comprising:

a switchback type conveyance path that is provided in said conveying path to invert an obverse or reverse surface of said sheet relative to each other;

wherein at least another cooling device is disposed along said switchback type conveyance path.

* * * * *